United States Patent [19]

Jenkins

[11] Patent Number: 4,492,584

[45] Date of Patent: Jan. 8, 1985

[54] TRANSFER PRINTING PROCESS FOR CELLULOSE FABRIC

[75] Inventor: Evans M. Jenkins, Thomasville, N.C.

[73] Assignee: Apollo Chemical Corporation, Burlington, N.C.

[21] Appl. No.: 409,397

[22] Filed: Aug. 19, 1982

[51] Int. Cl.[3] ..... D06M 13/34

[52] U.S. Cl. ..... 8/471; 8/185; 8/532; 8/585; 8/918

[58] Field of Search ..... 8/471, 566, 585, 185

[56] References Cited

U.S. PATENT DOCUMENTS

| | | | |
|---|---|---|---|
| 4,063,879 | 12/1977 | Faulhaber et al. | 8/471 |
| 4,072,462 | 2/1978 | Vellins et al. | 8/471 |
| 4,088,440 | 5/1978 | Leimbacher et al. | 8/471 |
| 4,210,412 | 7/1980 | Yamane | 8/471 |
| 4,304,565 | 12/1981 | Blanchard et al. | 8/471 |

FOREIGN PATENT DOCUMENTS 1445201 8/1976 United Kingdom .

OTHER PUBLICATIONS

G. B. Verburg et al., Textile Chemist and Colorist", 1969, vol. 1, (No. 27), pp. 595–599.

*Primary Examiner*—A. Lionel Clingman

*Attorney, Agent, or Firm*—Charles R. Rhodes; Judith E. Garmon

[57] ABSTRACT

A melamine derivitive resin such as melamine formaldehyde is polymerized, but not significantly cross-linked, within the natural or synthetic cellulosic fibrous structure of a textile fabric of the type having a significant percentage of natural or synthetic cellulosic fibers, wool, or other animal fibers (usually cotton) by either steam curing the resin or by ensuring that the resin polymerizes on the alkaline side as by, for example, using an alkaline or latent alkaline catalyst. The transfer printing step then is effected with the resulting fabric exhibiting good color levels with superior hand characteristics and excellent wash fastness, as well as other physical properties.

5 Claims, No Drawings

TRANSFER PRINTING PROCESS FOR CELLULOSE FABRIC

BACKGROUND OF THE INVENTION

This invention relates to the printing of fabrics by the method known commercially as heat transfer printing. In accordance with this method, a color pattern to be imparted to a fabric, e.g. a woven or knitted material or carpet, is initially prepared as a print on a heat transfer sheet or substrate, conventionally paper. The inks used for preparing the printed pattern are selected to volatize or sublime at a temperature acceptable to the substrate. The transfer is placed in contact with the fabric to be printed and heat is applied. As a result, the inks are transferred by heat to the fabric. The fabric must be of such a nature that it will receive and retain the transferred inks, so as to give a permanent print on the fabric. The mechanism of the transfer step is believed to be that the gases resulting from volatization or sublimation of the respective inks are absorbed by at least the outer surface layers of the individual fibers of the fabric. This effect can readily be obtained on many fabrics made from synthetic fibers, especially polyester fibers. As a result, large quantities of polyester fabrics items printed in this manner have been produced commercially. The method is relatively quick, simple to carry out, cheap in materials and labor, and results in a good permanent print in as many colors as are imparted to the original transfer sheet, and further results in low effluent wastes.

On the other hand, this technique has met with considerable difficulty when applied to fabrics containing cellulosic fibers, wool and other animal fibers, and other natural fibers (hereinafter referred to as "natural" fibers) and blends of such fibers with polyester and other synthetics. Primarily such blends are of a polyester and cotton, but others are within the scope of this disclosure. When transfer printing is attempted on fabrics containing such fibers and blends, the resulting print has been generally poor because the disperse dyes do not adhere to the natural fibers. As a result, the only way heretofore known to obtain adherence of the transfer print to fabrics containing cellulosic or natural fibers is by utilizing a cross-linking treatment of the cellulosic fibers to be printed. In these cross-linking treatments an aqueous solution of cross-linking agents or reactants is applied to the fabric. These cross-linking agents or reactants do not form polymers in the normal sense (i.e. polymerize), but react with the hydroxyl groups of the cellulose and form bridges. These reactions make the cellulosic fibers more receptive to the disperse dyes. While this technique has obtained some success as far as color level is concerned, the hand of the resulting material is extremely poor and for the most part unacceptable other than for novelty items. This is due to the cross-linking that occurs which is caused by heat and the presence of acid catalysts or latent acid catalysts.

Various attempts to solve this problem are outlined below:

First of all, U.S. Pat. No. 4,072,462 to Vellins et al is directed to an attempt to solve the problem by first treating such fabrics with reactants chosen to have hydroxymethyl, alkoxymethyl and/or aldehyde groups capable of reacting with corresponding reactive amino, hydroxy and/or hydroxyalkylamino groups of the dye or dyes used in the printing inks. After treatment, the fabric is left uncured or only partially uncured, and the cure is completed at the time of the transfer printing operation. In the resulting fabric the color levels are too low, and the hand is stiff and boardy. The fabric in general is unacceptable from a commercial standpoint. Acid salts are taught by Vellins to be used as accelerators or catalysts to ensure an adequate cure as is conventionally and well known. It is believed that this acid salt catalyst at least partially leads to the unacceptable hand characteristics. One further note, the aqueous solution with the reactant therein is very unstable and precipitation occurs from four to twelve hours after preparation.

In a British patent No. 1,445,201 to Lambert, the disclosed solution to the problem involves the use of an alkylated melamine formaldehyde reactant which utilizes from four to six formaldehyde groups per melamine unit. In addition, very strong acids are used as catalysts. The resulting color levels are not bright and again the fabric exhibits a relatively coarse hand. Further, the wash fastness with this approach is reduced and poor. The shelf life of the treatment bath is again very short (less than two hours).

In U.S. Pat. No. 4,063,879 to Faulhaber et al, the same problem is approached and an attempt to solve the problem includes the application of a highly methylated melamine derivative without any curing at all, only drying. An acid catalyst is then applied with the disperse dye ink and curing takes place simultaneously with the transfer dyeing step. The resulting fabric exhibits good color depth but an extremely poor and commercially unsatisfactory hand. In addition, the treatment tends to yellow the fabric. Again, it is believed this occurs because of the strong acid catalyst used.

In U.S. Pat. No. 4,088,440 to Leimbacher et al, essentially the same cross-linking reactants that are utilized in the British patent to Lambert and the patent to Vellins above are utilized and then cured in the presence of an acid salt catalyst at the time of transfer printing. Again, the result is extremely poor and exhibits a commercially unsatisfactory hand, as well as yellowing of the fabric.

In the present invention, as opposed to the cross-linking approach, the inventor has found that if the reactants are cured in such a manner that the reactants polymerize into the fiber structure of the fabric, the disperse dye ink will have good affinity for the resin; and as a result the hand of the resulting fabric is surprisingly good. The aforementioned goal of polymerizing the reactants to form a polymer within the fibers rather than cross-linking with the cellulosic fibers of the fabric is accomplished by either steam curing the fabric (effecting polymerization in the presence of steam) or utilizing a catalyst that produces an alkaline pH. In all known approaches to this problem, the catalysts utilized for cross-linking melamine derivative reactants are acids, or acid developing types. The inventor here has found that alkaline catalysts such as sodium hydroxide, potassium hydroxide, or the like will cause the reactants to cure or polymerize on the alkaline side. The results of such curing on the alkaline side or curing in the presence of steam has exhibited tremendously satisfactory results. The color is deep, and the hand is superior to any other known technique. It is, of course, possible and perhaps preferable, to additionally use such optional additives as softeners, wetting agents, acrylic emulsions, humectants, or other chemicals capable of altering fabric feel and/or appearance. Such additives do not adversely alter the effectiveness of the melamine formaldehyde resin treatment outlined above. To the contrary one such group of known additives are the glycols such as ethylene glycol, triethylene glycol, polyethylene glycol and polypropylene glycol. These glycols normally serve to inhibit formaldehyde release, have evidenced compatability with the approach of the invention, and actually improve the color level to such a substantial extent that they should be incorporated into preferred embodiments of the invention.

As far as the appropriate reactants to use are concerned, methylated trimethylol melamine is preferred; however, one, two or four formaldehyde groups per melamine unit are also believed acceptable.

The melamine formaldehyde reactants may be used in an aqueous or possibly in an organic solvent system, and when an alkaline catalyst or accelerator is used, such alkaline catalysts as sodium hydroxide provide excellent results. It has been noted that if the curing process can be so controlled as to polymerize the resin of a pH of 8.5 to 10, superior hand results are noted. Methylated trimethylol melamine polymerizes in the presence of heat in the absence of any cross-linking catalysts; however, if such is attempted it is important to note that the polymerization must occur at an alkaline pH, and care must be taken not to add acids to the extent that the methylated trimethylol melamine will be cross-linked on the acid side resulting in a stiff fabric hand.

Electron scanning micrographic studies indicate that when either the cure is carried out in the presence of moisture (i.e. steam) or in the absence of an acid catalyst the resin polymerizes and traps the fibers in a swollen state. It is believed that this is the reason for the superior prints, hand, and wash-fastness characteristics.

Formaldehyde release is a problem that has become much more important in recent years. Since the resin is cured at the time the fabric is treated, there should be no significant formaldehyde release at the time the transfer printing step is achieved or thereafter. To ensure that any such formaldehyde release will be minimal certain additional additives such as diethylene gylcol (DEG) may be used to inhibit the formaldehyde release, as well as surprisingly improve the color level as has been noted in testing. Certain wetting agents also appear to enhance the results when used in combination with the reactant described above.

The following examples illustrate preferred embodiments of the invention.

EXAMPLE I

A control sample or swatch of fabric formed of a 50/50 blend of polyester and cotton was provided with no preliminary treatment at all. The untreated fabric was merely heat transfer printed with a rainbow pattern at 210° C. for 20 seconds. The color level of the resulting fabric was measured using a spectrophotometer with associated computer incorporating several color systems into the computer data, but chiefly relying upon the CIE color system (Commission Internationale L'Eclairage - The International Commission on Illumination), an international standard for measuring, designating and matching colors. The sample color swatch displayed low color levels as the disperse dye would not adhere to the cotton fibers.

EXAMPLE II

A second sample of fabric formed of the same blend of fibers as the swatch of Example I was subjected to a pre-treatment in which an aqueous solution containing 88.9% water, 8% methylated trimethylol melamine, 2% diethylene glycol, 1.0% ethoxylated alcohol (wetting agent), and 0.1% ethylene urea. An alkaline catalyst (NaOH) was added to the solution in an amount sufficient to ensure that the subsequent polymerization of the resin would occur at a pH of 9.5. It has been determined that 0.007% by weight of the bath is sufficient. The bath was padded onto the fabric and roll squeezed such that a 100% pickup was achieved. The fabric was then dried at 80° C., and cured at 170° C. for sixty seconds. There followed the same printing operation as carried out in Example I. The results show, again using the spectrophotometer color comparison, that the resulting fabric had an excellent initial color level indicating good affinity for the dyes. Further, and most importantly, the hand of the resulting fabric is excellent. This evidences good commercial acceptability from the standpoint of both color level and hand. The wash fastness was also excellent.

EXAMPLE III

A sample of the same fabric as selected in Examples I and II was treated in the same manner as the fabric of Example II with the exception that the reactant selected was a methylated hexamethylol melamine, and was applied with the same catalyst in the same amounts as set forth in Example II. The result showed a slightly improved initial color level; however, the hand was again somewhat stiff and not as commercially acceptable.

EXAMPLE IV

A sample of identical fabric as used in Examples I–III was treated and printed in the same manner as Example II with the exception that a different wetting agent, namely Apolloterge IAD, a proprietary alcohol/ether condensate available from Apollo Chemical Corporation of Burlington, N.C., was used in place of the ethoxylated alcohol. The wetting agent was added to the treating solution in amounts of 1%. The resulting fabric after printing showed to be almost as good from the standpoint of color level, excellent from the standpoint of wash-fastness, and also exhibited an excellent hand. This sample was commercially acceptable.

EXAMPLE V

Another fabric of the same type as set forth in Examples I–IV was treated in substantially the same manner as set forth in Example II with the exception that polyethylene gylcol was substituted for the diethylene gylcol, and the fabric was printed in the same manner. The resulting color tests showed excellent color levels and washfastness characteristics, which was an improvement over that of the fabric of Example II. In addition, the resulting fabric evidenced excellent and commercially acceptable hand characteristics.

EXAMPLE VI

A fabric sample of the same type as chosen in Examples I–V was selected and treated with an aqueous solution of 91% $H_2O$, 8% methylated trimethylol melamine, and 1% ethoxylated alcohol. No alkaline catalyst was used. The solution was padded onto a fabric swatch and roll squeezed to a 100% pickup. The fabric was then exposed to live steam for 120 seconds, and dried at 100° C. Curing of the swatch was carried out at 170° for sixty seconds. The resulting fabric sample exhibited excellent levels, good washfastness, and an excellent, commercially acceptable hand was obtained. Further, tests showed that steam treatment for as low as thirty seconds also produced excellent results.

The above tests were carried out on a 50/50 blend of polyester and cotton and exhibit that the melamine reactants should be added in the range of 6–8% by weight of the aqueous solution assuming a 100% pickup. In blends containing less cotton, such as 65/35 blends, the melamine reactants would be less, e.g. in the range of 5–7%.

The results indicate that this process of polymerizing melamine inside the cellulosic fiber without cross-linking, whether with an alkaline catalyst or in the presence of steam, results in fabrics which can be successfully heat transfer printed to such a degree of success that the resulting fabrics are commercially acceptable; i.e. the color level is excellent, the washfastness is excellent, the hand is superior, and there appears to be very low levels of formaldehyde release on storage. In addition to laboratory tests actual plant trials have confirmed the laboratory tests.

What is claimed is:

1. A method for heat transfer printing a disperse dye formulation from a transfer paper onto a textile fabric of the type composed of a natural and/or synthetic cellulosic material alone or in a blend with at least one natural and/or synthetic cellulosic material; said method comprising the steps of:

(a) impregnating said textile fabric with an aqueous solution of methylated trimethylol melamine reactant;

(b) polymerizing said methylated trimethylol melamine reactant in the total absence of any acidic or potentially acidic catalyst under such condtions that the reactant polymerizes within the fiberous structure of said fabric without substantially cross-linking said reactant to said fibers;

(c) said polymerizing step being carried out to according to one of the procedures selected from the group consisting of (1) subjecting the impregnated fabric to a steaming operation for at least thirty seconds, then drying at substantially 100° C. and curing at substantially 170° C.; and (2) maintaining the pH of said reactant during polymerization in the range of 8.5 to 10 by initially adding an alkaline catalyst selected from the group containing sodium hydroxide and potassium hydroxide to said aqueous solution, then subjecting said textile fabric to a drying operation at a temperature of substantially 80° C. and a subsequent curing operation at a temperature of substantially 170° C.;

(d) heat transfer printing onto said fabric.

2. The method according to claim 1 wherein said reactant comprises at least 7% by weight of said aqueous solution in a 50/50 polyester-cotton blend fabric.

3. The method according to claim 1 wherein said reactant comprises at least 5% by weight of said aqueous solution in a 65/35 polyester-cotton blend fabric.

4. The method according to claim 1 wherein said aqueous solution further includes the addition of a gylcol additive in amounts in the range of 1.5 to 2.5% by weight of the aqueous solution.

5. The method according to claim 1 wherein the aqueous solution further includes the addition of substantially 1% of a wetting agent.

* * * * *